US007400245B1

(12) United States Patent
Johnson

(10) Patent No.: US 7,400,245 B1
(45) Date of Patent: Jul. 15, 2008

(54) PERSONAL SAFETY SYSTEM FOR EVIDENCE COLLECTION AND RETRIEVAL TO PROVIDE CRITICAL INFORMATION FOR RESCUE

(76) Inventor: Joyce Claire Johnson, 3473 Meadowlands La., San Jose, CA (US) 95135

( * ) Notice: Subject to any disclaimer, the term of this patent is extended or adjusted under 35 U.S.C. 154(b) by 555 days.

(21) Appl. No.: 10/858,527

(22) Filed: Jun. 1, 2004

Related U.S. Application Data

(60) Provisional application No. 60/476,088, filed on Jun. 4, 2003.

(51) Int. Cl.
*G08B 1/08* (2006.01)

(52) U.S. Cl. ..... 340/539.13; 340/539.1; 340/539.11; 340/825.36; 340/825.49

(58) Field of Classification Search ..... 340/539.13, 340/539.1, 539.11, 825.36, 825.49
See application file for complete search history.

(56) References Cited

U.S. PATENT DOCUMENTS 4,694,284 A 9/1987 Leveille
5,021,794 A 6/1991 Lawrence
5,936,530 A 8/1999 Meinhold
6,175,329 B1 1/2001 Vicci
D453,483 S 2/2002 Choe
6,940,403 B2 * 9/2005 Kail, IV ..... 340/539.12
2002/0175820 A1 11/2002 Oja
2003/0034887 A1 2/2003 Crabtree
2003/0162508 A1 8/2003 Macias

* cited by examiner

*Primary Examiner*—Daryl C Pope
(74) *Attorney, Agent, or Firm*—Kenyon & Kenyon LLP

(57) ABSTRACT

A personal safety system (8) carried for emergency or abduction preparedness where information might need to be captured and left behind as evidence for the safe return of the user. The user may capture voice or video information and then throw it down and leave it behind at the crime scene for later location discovery and evidence recovery. By removal of pull-pin (12) PSS (8) is activated and recording is available through microphone (18) into voice recording solid-state chip with playback (14). An RF transmitter and antenna (9) is also activated for position discovery by the rescue team once notification is made that user has gone missing. A portable hand-held RF receiver (20) with directional antenna apparatus (44) and a received signal strength indicator (46) is used to help locate the personal safety system (8) and the crime scene. The power source (29) operates the unit and safely maintains the recorded evidence. The components are embedded in a housing (23) that is made rugged material for survivability outdoors in the elements. Once located, the captured forensic information is retrieved via a headphone (19) via the interconnect jack (11).

173 Claims, 7 Drawing Sheets

Figure 1:
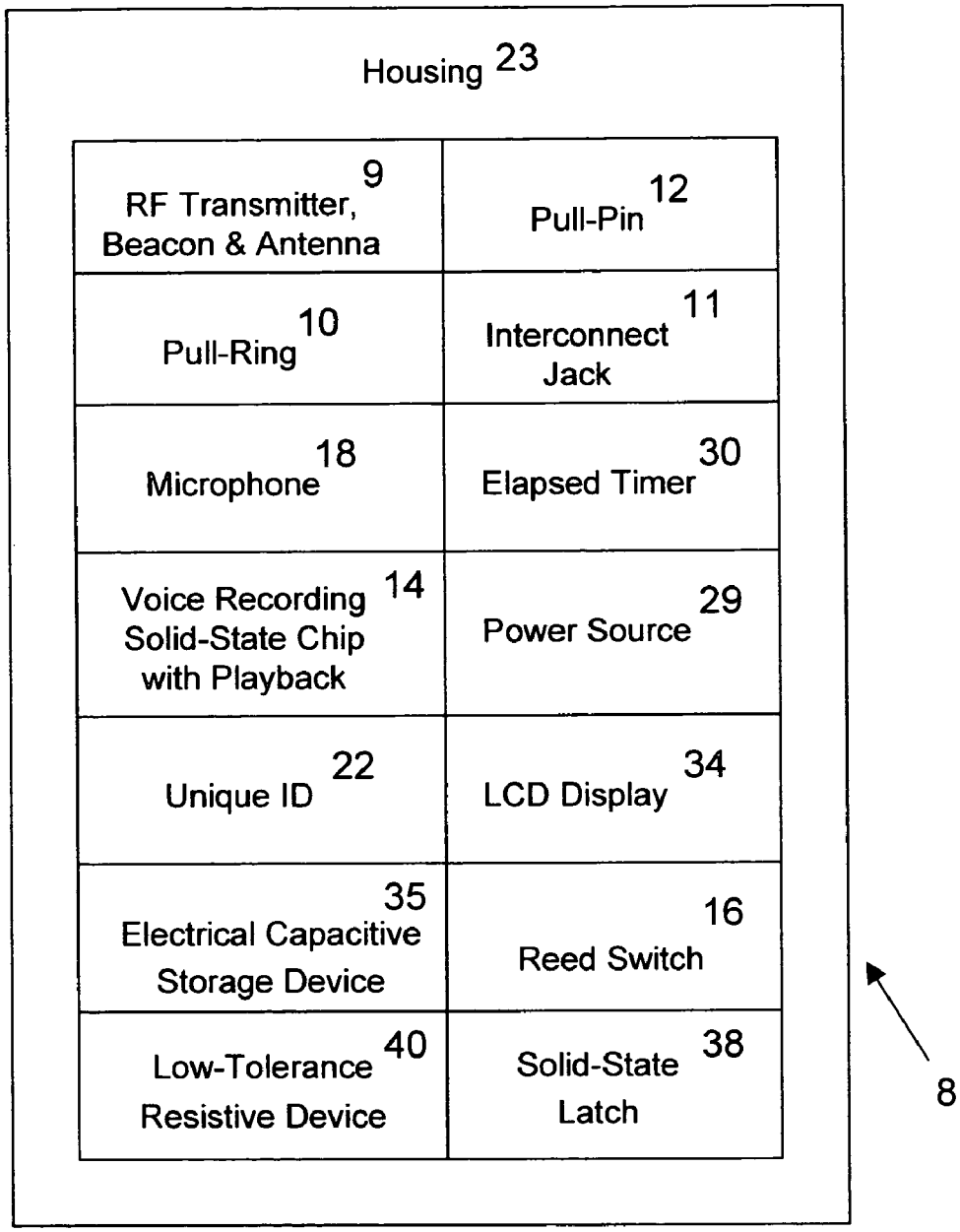

PERSONAL SAFETY SYSTEM FOR EVIDENCE COLLECTION AND RETRIEVAL TO PROVIDE CRITICAL INFORMATION FOR RESCUE

CROSS-REFERENCE TO RELATED APPLICATIONS

This application is entitled to the benefit of Provisional Patent Application Ser. No. 60/476,088, filed Jun. 4, 2003.

FEDERALLY SPONSORED RESEARCH

Not Applicable

SEQUENCE LISTING OR PROGRAM

Not Applicable

BACKGROUND OF THE INVENTION

1. Field of Invention

This invention relates to personal safety, specifically to a method of capturing an event and leaving a high technology trail of evidence that may be easily located and collected.

2. Background of the Invention

A growing problem in our society today is stranger abduction. Parents, communities, abducted children's foundations and law enforcement agencies have mounted a crusade to stop these events and bring the already abducted home.

Inventors have created several types of locator devices to assist in the recovery of objects and individuals. Most human oriented locator devices aim to track a person's location. The components required for a tracking approach present several downfalls. In Pat. D453,483 Missing Person Locator Set to Choe, 2002 Feb. 12, and Patent Application 20030034887 Article Locator System by Crabtree, 2003 Feb. 20, and Patent Application 20020175820 Tracking Device by Oja, 2002 Mar. 13, a RF infrastructure is required to monitor a worn RF device that advises when a worn device goes out of range. This approach is inferior because the user's travel is limited to the coverage area of the RF technology in use and is therefore not suitable in an abduction scenario where the abducted may be taken far away.

Other patents such as U.S. Pat. Nos. 5,936,530 Child Protection Device to Meinhold 1999 Aug. 10, and U.S. Pat. No. 4,694,284 Abduction-Preventing Collar to Leveille, 1987 Sep. 15, and U.S. Pat. No. 5,021,794 Personal Emergency Locator System to Lawrence, 1991 Jun. 4, carry the same infrastructure downfall. In addition, these patents require devices such as a watch, or a collar, or a RF device in the clothing to remain on the wearer. Although cut-resistant, these devices can be removed by the assailant by either cutting them off or by removing the victims clothing. This may present a condition where injury could be caused by the abductor's removal of these devices.

Also, it is inherent that these devices require much battery power for operation of signals that are constantly communicating with the infrastructure. Battery management is required to maintain the device in usable form. Batteries tend to run down at the most inopportune times rendering these devices not feasible as emergency devices in an "abduction" scenario. The product may not be used if battery management is required because of inconvenience of keeping batteries charged. If the product is used, batteries may not be fully charged and ready in an emergency situation. A device may also mistakenly be left on or have a used battery rendering the emergency device unreliable. In addition, the abducted will not be allowed to perform battery maintenance operations such as re-charging the device.

Also, current approaches are too costly to provide safety for the general public. In the case of the RF devices, a large RF infrastructure becomes price prohibitive. Even as cell phone usage expands, although not perfect for emergencies (drained batteries, limited coverage, assailant removal), cell phones and service plans are price prohibitive as a general public safety device. Likewise in the case of GPS (Global Positioning Systems) as in U.S. Pat. No. 6,175,329 Automatic Emergency and Position Indicator to Vicci, 2001 Jan. 16, although this art is possibly a more reliable form of emergency message transmission compared to cell phones, we do not see them in everyday use since the user devices themselves and associated services are also price prohibitive for mass public safety.

Commercially available electronic personal locator devices or personal beacons have a number of downfalls. They are large and heavy and not easily carried on a backpacking trip much less concealed and used for safety on a day-to-day basis. Since these transmit on the emergency channel, they are not feasible for general population day-to-day use since in general usage they would be activated in many situations for both real and false alarms. Emergency and rescue services could most likely not keep up with the activation of these units. These are also very expensive costing in the hundreds of dollars. Therefore because of their size, weight, transmission channel, and expense, these devices are neither affordable nor practical for day-to-day usage.

Similarly, in US patent application 20030162508 Miniature Electronic Personal Locator Beacon by Macias, 2003 Aug. 28, a beacon is used to signal a person overboard a ship on the VHF 1215 MHz distress channel. This art differs in many ways from my personal safety system. Firstly, a manual button, or a water-sensor upon a user falling overboard a ship into the water, actuates the beacon. This design is obviously not for use in abduction type emergency situations since the victim would need to either fall into water for automatic activation or have to rely on pressing a button that could be difficult to find and press in an emergency situation. Secondly, with this device also, we would need to rely on the abductor not removing the unit from the victim. Thirdly, the device is designed with a micro controller and VHF beacon making it costly for mass public safety use. Fourthly, battery management would be required. Fifthly, emergency signaling of the distress channel would not be feasible as an everyday safety device for the general public as the emergency channel could not reply to all needs.

In these prior art examples the task was to track, or the device had to remain charged and on the victim, or the device, service, or infrastructure was price prohibitive. All the personal locator systems heretofore known suffer from a number of disadvantages:

(a) An RF device that is designed to remain on the person, if taken off, is rendered useless (b) With RF device usage, once a person is removed from the general vicinity or a defined RF coverage area the device is rendered useless (c) Prior art neglects to collect any evidence so if these devices are eventually located and retrieved they tell little of what happened and at that point are not helpful for rescue (d) Battery power is consumed readily with units that are continually on and communicating with an RF infrastructure (e) Batteries can wear down providing an emergency unit not emergency capable. Also in previous designs the unit must continue to be charged after abduction for recovery
(f) RF infrastructure required by some devices render them price prohibitive and impractical for large coverage areas. GPS tracking systems can also be price prohibitive for the mass market
(g) High price coupled with the above disadvantages render most devices impractical and imperfect in a cost/risk/justification model
(h) Prior art devices are not a deterrent as long as the perpetrator can take the device off of the victim
(i) As with cell phones, children can not be tasked to have a device, out, charged, and at hand, when they need help
(j) In the case of emergency locator systems operating on the distress channel, this channel is more appropriate at sea than for the safety of the general mass public for day-to-day usage
(k) In one case sited, actuation is not automatic unless upon falling into water
(l) In the case of current emergency locator systems, they are large and heavy and expensive

OBJECTS AND ADVANTAGES

Accordingly, several objects and advantages of my personal safety system are:

(a) to provide a device to collect evidence that is to be thrown, dropped, or left at the scene of the event rather than to rely on it remaining on the victim
(b) to provide a device where it does not matter how far the victim is taken from the general vicinity, the evidence is collected and left behind within my personal safety system
(c) to provide a device so that even if somewhere along the path of the abduction if the device is retrieved it could provide evidence
(d) to provide a device that requires little power because no continual RF communication is required
(e) to provide a device that is on only once activated in an emergency, when in danger, or to memorialize an event, thereby eliminating battery management
(f) to provide a device that requires no RF infrastructure to make it viable but rather one that uses a beacon for position discovery of a device left behind at the scene
(g) to provide a device that makes sense for the general public from a cost/risk/performance standpoint
(h) to provide an inexpensive device so that users can afford to have many at once and use them when foul play is suspected even if it doesn't materialize
(i) to provide a device which allows a user to simply grab the device and pull it for activation
(j) to provide a device that does not alarm the emergency and rescue band but one that can be located by local search and rescue Other objects and advantages include:

(a) to provide a device with a unique id so that law enforcement will know who the owner is through prior owner identification completion
(b) to provide a device that is a deterrent in the first place such as when the target victim is seen throwing something once it is common knowledge that evidence can be left behind so easily
(c) to provide a device that is a deterrent since after recorded and thrown an abductor may quickly search for it giving the split second that it may take for a passerby to see something or for the victim to get away
(d) to provide a device that is very accessible and reached easily without fumbling for it where one may be kept bedside, on the car dashboard, sewn onto clothing, tied onto shoestrings, worn as a necklace—all places very accessible so the device is very usable and always ready to go
(e) to provide a device that can provide the critical, early evidence since minimal elapsed time is critical for the best possible chance of getting home safely in abduction cases
(f) to provide a device which in one embodiment has two RF transmitters; one that says on the person for the possibility that the victim may be able to keep it on them or on their clothes heaped in a pile somewhere, while the rest of the device is the traditional pull away unit that gets thrown as a "shred" of evidence
(g) to provide a device that can provide a date and time stamp so that suspects can be ruled in or out based on an exact time stamp instead of a best guess
(h) to provide evidence that may be found sooner than later while surrounding evidence is still fresh and the trail of the possible suspect is still warm
(i) to provide a device which is always available in an emergency situation in various fun shapes and sizes that can be snapped onto a key ring, sewn onto clothing, hooked onto zipper pulls, so that in an emergency situation it is quickly available
(j) to provide a device to assist law enforcement to find other evidence. It may lead them to a location where perhaps there was a struggle or to a location that the user thought well advised to leave a device or a "shred of evidence" there to mark the spot. It may lead law enforcement there sooner while the evidence may still be viable and even available.

Further objects and advantages of my personal safety system will become apparent from a consideration of the drawings and ensuing description.

SUMMARY

In accordance with my invention a personal safety system (PSS) comprises a system for capturing information and for position discovery of that information contained within the PSS for later retrieval of the captured information. These components are embedded in an environmentally sound housing arranged for easy activation and can be activated easily in an emergency. A radio frequency receiver is used to locate a deployed PSS.

DRAWINGS

Figures

FIG. 1 is a schematic block diagram of the preferred embodiment of my personal safety system (PSS)

Figure 2A:
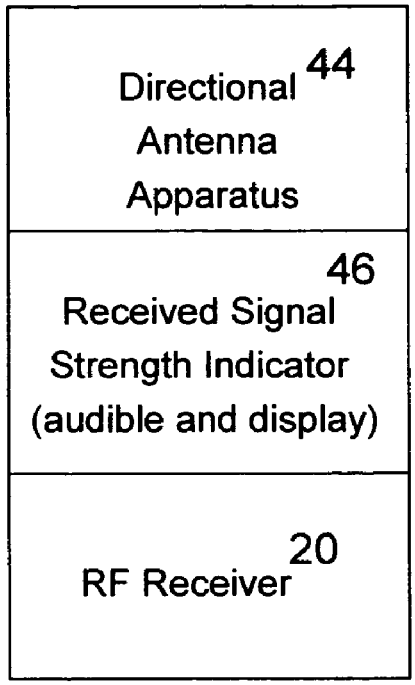
Figure 2B:
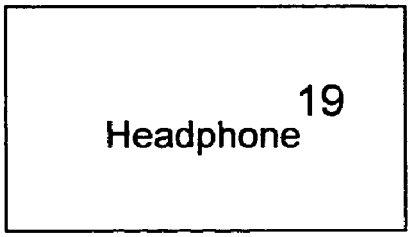
Figure 2C:
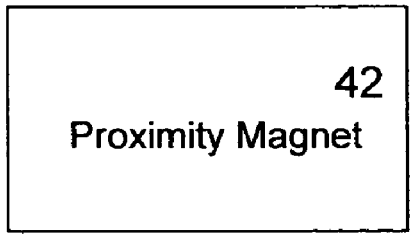
Figure 3:
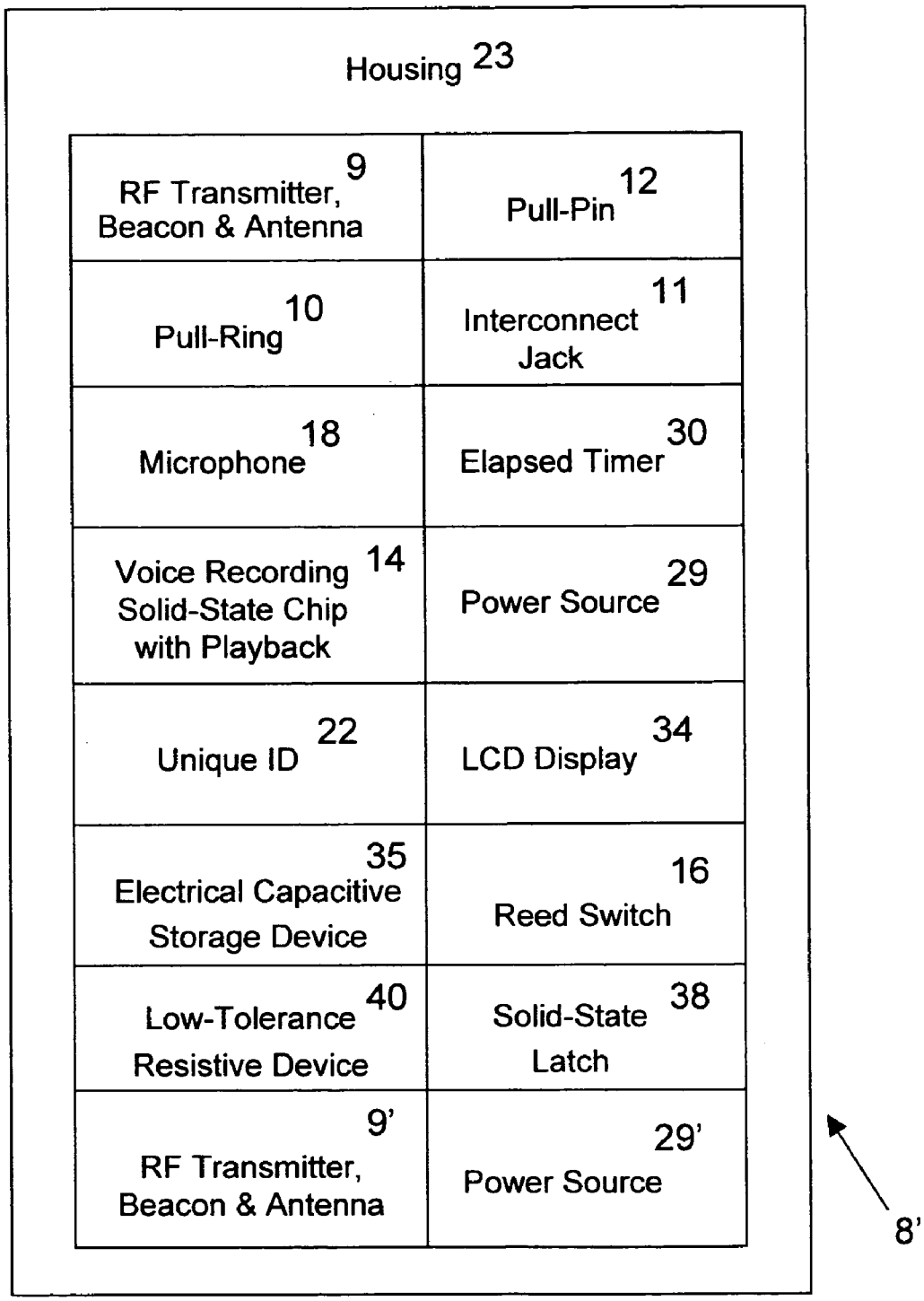
Figure 4:
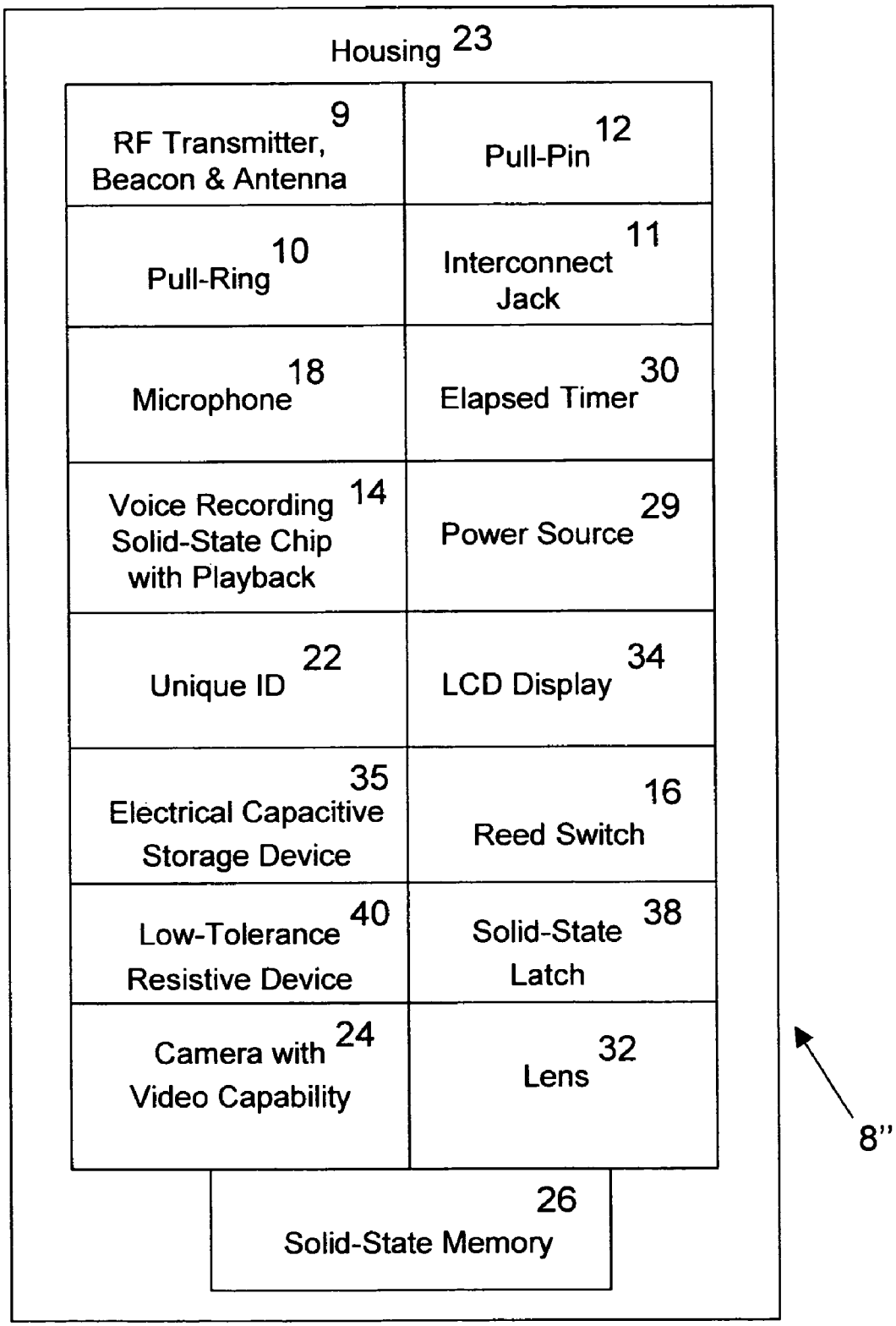
Figure 5:
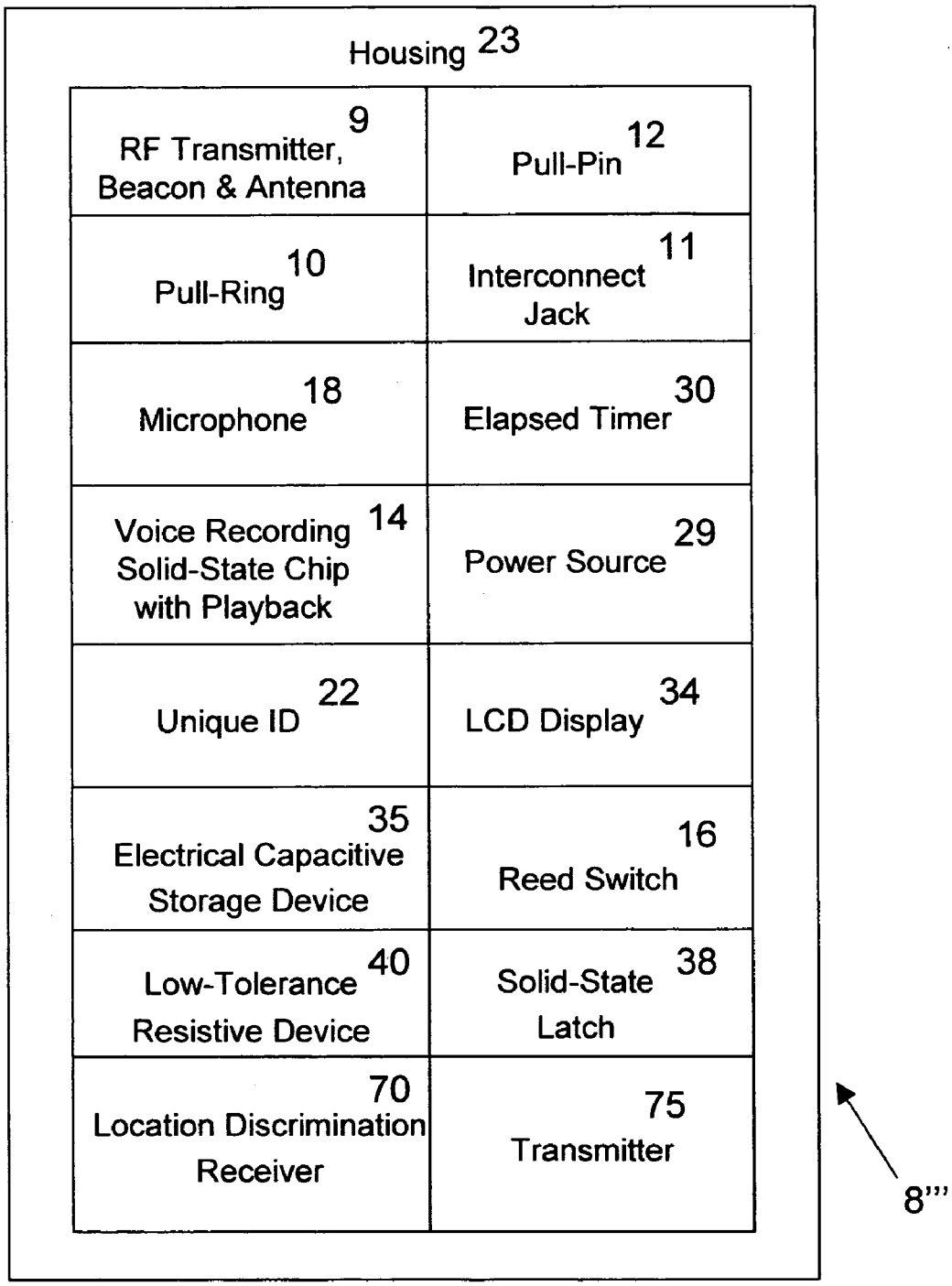
Figure 6:
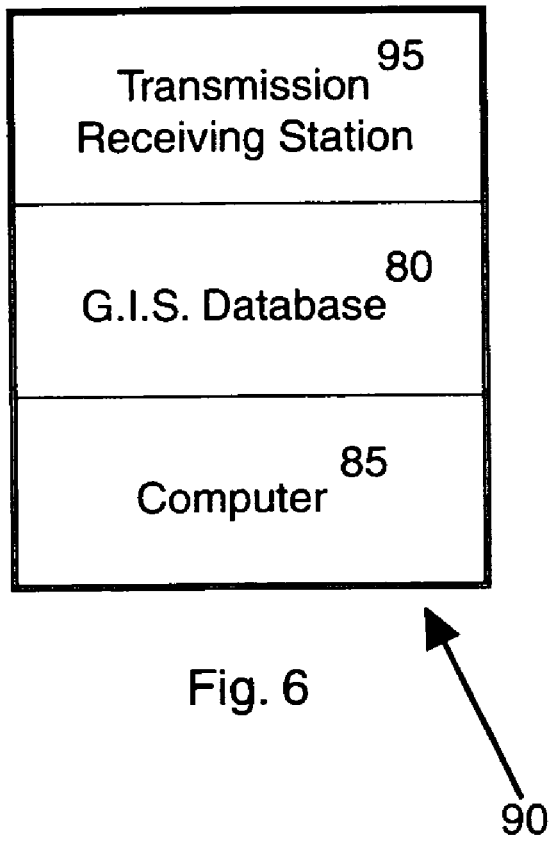

FIGS. 2A, 2B, and 2C are block diagrams of locating and information retrieval tools FIG. 3 is a schematic block diagram of an additional embodiment of my PSS with a redundant RF transmitter, antenna, and power source designed to remain behind with the victim FIG. 4 is a schematic block diagram of an additional embodiment of my PSS with a camera with video capability to collect even more evidentiary data FIG. 5 is a schematic block diagram of an additional embodiment of my PSS with an embedded location discrimination receiver and transmitter FIG. 6 is a block diagram of the PSS Monitoring System that receives transmissions from the embodiment of FIG. 5

Figure 7:
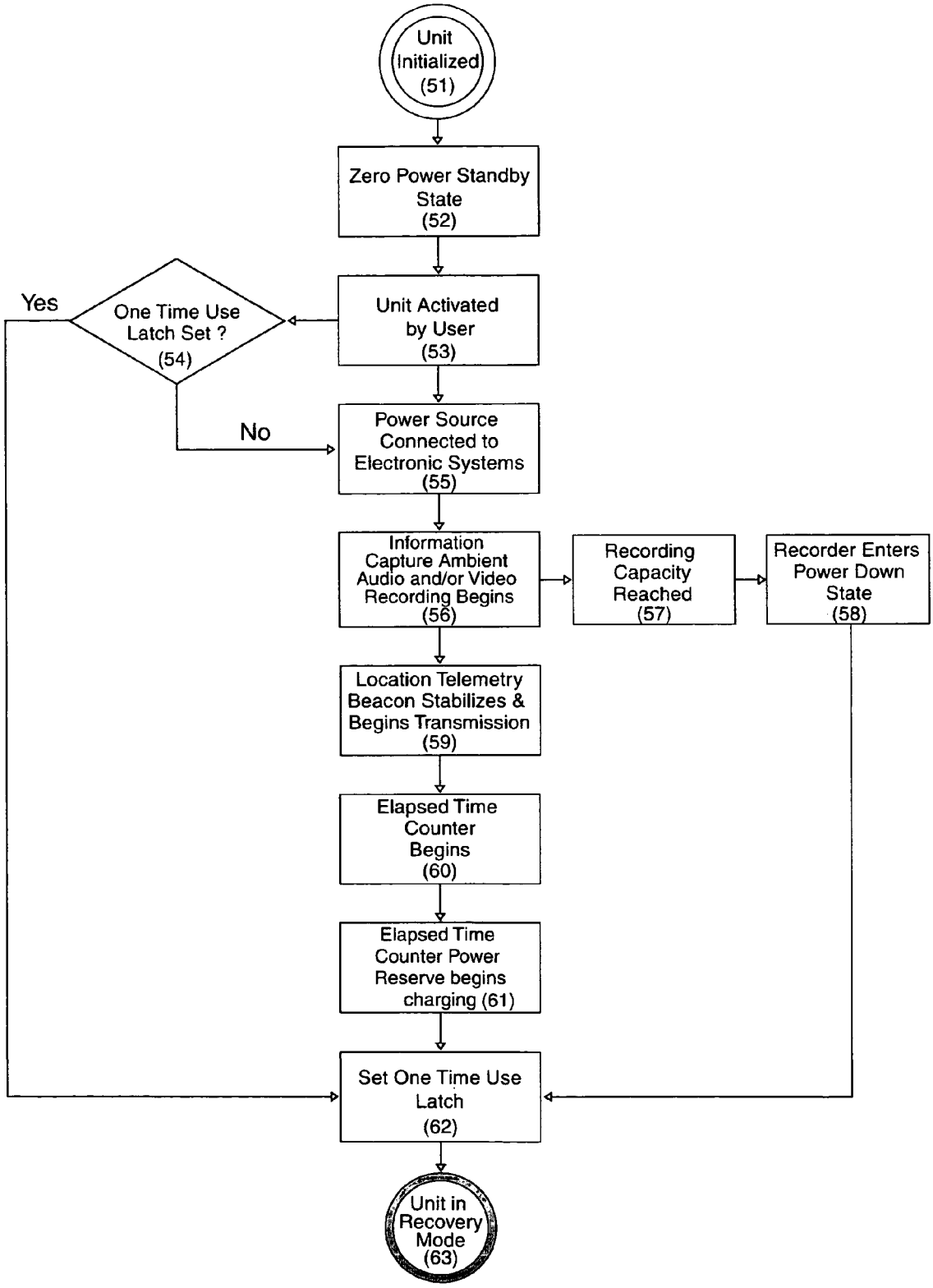

FIG. 7 is a flowchart of the PSS initialization and power control system

| DRAWINGS - Reference Numerals | |
|---|---|
| 8 Personal Safety System (PSS) | 9 RF Transmitter, Beacon, and Antenna |
| 9' RF Transmitter, Beacon, and Antenna | 10 Pull-Ring |
| 11 Interconnect Jack | 12 Pull-Pin |
| 14 Voice Recording Solid-State Chip with Playback | 16 Reed Switch |
| 18 Microphone | 19 Headphone |
| 20 RF Receiver | 22 Unique ID |
| 23 Housing | 24 Camera with Video Capability |
| 26 Solid-State Memory | 29 Power Source |
| 29' Power Source | 30 Elapsed Timer |
| 32 Lens | 34 LCD Display |
| 35 Electrical Capacitive Storage Device | 38 Solid-State Latch |
| 40 Low-Tolerance Resistive Device | 42 Proximity Magnet |
| 44 Directional Antenna Apparatus | 46 Received Signal Strength Indicator (audible & display) |
| 51-63 are used in FIG 7 flowchart | |
| 70 Location Discrimination Receiver | 75 Transmitter |
| 80 G.I.S. Database | 85 Computer |
| 90 PSS Monitoring System | 95 Transmission Receiving Station |

DETAILED DESCRIPTION

FIGS. 1, 2A, 2B, & 2C—Preferred Embodiment

FIG. 1 is a schematic block diagram of a preferred embodiment of my personal safety system (PSS) 8 comprising a pull-ring 10 connected to a pull-pin 12, which is a trigger for activation of a voice recording solid-state chip with playback 14 for voice recording through a microphone 18. Also activated by pull-pin 12 are a RF transmitter, beacon, and antenna 9, and an elapsed timer 30. Electrical capacitive storage device 35 provides power reserve for elapsed timer 30 for data retention after the main batteries are no longer able to supply power to all systems. Also included is a unique id 22 and a LCD display 34 allowing elapsed time to be determined. A power source 29 provides battery power. An interconnect jack 11 allows for retrieval of recorded information and is the same location in which pull-pin 12 resides until activation. A solid-state latch 38 is included to assure that the unit can be activated only once. A low-tolerance resistive device 40 is used to alter the audio frequency of RF transmitter, beacon, and antenna 9 based on temperature.

FIGS. 2A, 2B, and 2C show PSS 8 retrieval tools. A RF receiver 20 along with a directional antenna apparatus 44 allows for locating PSS 8. A received signal strength indicator 46 provides for searching in the correct direction and homing in on PSS 8. A proximity magnet 42 activates a magnetic switch inside PSS 8 for retrieval of collected information allowing audio retrieval of information through headphone 19.

Theory of Operation

It is most often the case that parents or relatives or law enforcement know the approximate vicinity where a victim went missing, therefore for speedy rescue it is a good idea for the victim to leave behind as much evidence as is possible at the scene. My personal safety system with its combination of components integrated into an easily attached small unit, requiring minimal power, which can be thrown down and left behind, makes this possible. In the preferred embodiment, this PSS offers data collection of evidence, leaving a trail of evidence behind at the crime scene for retrieval by a search team.

In another embodiment my PSS offers a redundant RF transmitter that acts as a beacon designed to remain on the victim. In many cases abduction victims are kept within a two-mile area of their disappearance for the first 24 hours possibly making the beacon remaining with the victim useful for finding them during this window of time. In this way if the victim is being held in a house in the neighborhood being canvassed immediately following news of an abduction, law enforcement would be able to listen for the beacon with the associated locating tools and rescue the victim. This embodiment is offered in the off chance that the beacon may be allowed to stay on the victim or perhaps on the victim's clothing piled somewhere close by, while the rest of the PSS is thrown down at the scene.

With abduction widespread in our society today, better solutions are needed. Time is the urgent element in abduction, and evidence as early as possible is critical for a safe rescue and return home. The earlier evidence is available the better. In most cases evidence is not available within the first 48 hours and by then it is usually too late for a safe return. So we need a method of capturing some evidence and having some out there when search and rescue teams and law enforcement inevitably go searching for information and evidence in abduction cases.

In most cases family and friends know the path of the abducted and alert law enforcement to those areas for collection of evidence. To further highlight that point, the following are scenarios of recent stranger abduction cases, all in which the victims travels were well known. In each of the following scenarios the victim could have left a possible lifesaving trail with my personal safety system:

- He was on his way home from school (so police searched this area)
- She was waiting at the bus stop (crime scene search ensued here)
- She was last seen with a man who escorted her home to her apartment, her car was found outside (investigators determined she was abducted after going home)
- She was taken at knifepoint from her bed (search and rescue teams combed her room and the wooded area near her home for clues)
- She was walking her dog on her regular route (police and well organized community search teams searched her route and surrounding areas)
- The last internet site on her computer was the nearby memorial park and it looked as though she walked to the park from her apartment (the park was scoured for evidence; 11 months later they found her remains where they had formerly searched)

In all of these examples, my personal safety system could have been used to leave evidence at the scene that would have easily been found with its discovery-components onboard as other evidence was collected. Perhaps even leading search teams to other evidence while it is still fresh evidence providing a chance for rescue before evidence goes stale.

Although the device is visibly recognizable, law enforcement and rescue teams will use a commercially available hand-held portable RF receiver to scan for the RF transmitter acting as a homing signal embedded in the PSS.

Operation—FIGS. 1, 2A & 2B

In operation, the user completes an identification card to link PSS 8 through its unique id 22 to the user. One attaches PSS 8 to oneself or surroundings such as, attached to a zipper pull, a purse, one's key ring, one's shoelace ties, a bedside table while sleeping, or one's car dashboard. It may be attached via pull-ring 10 onto a jacket, belt loop, pants, pocket, or a blouse for easy retrieval in an emergency. Perhaps it is attached via pull-ring 10 to a lanyard, necklace, bracelet or belt loop.

With PSS 8 in position it is now ready for use. It is the user's assessment of the situation that determines it usage. When approached in a dark alley, or on a child's way to school, or out walking one's dog, or even assaulted while asleep in one's bed the user pulls PSS 8 from its nearby location pulling pull-ring 10 and dislodging pull-pin 12 thereby activating an electrical cascade to start the operation of components within PSS 8.

Pull-pin 12 may be a commonly used contact trigger such as one preventing battery contact that once removed actuates the components within. These components include voice recorder 14, RF transmitter 9, and elapsed timer 30. The user observes as much as possible and verbally records this information into microphone 18. Observations may be license plate number, make, model and color of car, permanent and temporary descriptions of the assailant namely skin color, tattoos, height, weight, hair color, and clothing type and color or simply ambient noise may be recorded. The user than leaves it at the scene by throwing it into the weeds or bushes, or throwing it under the bed at the scene. PSS 8 lies there as a crumb of evidence in a housing 23 that is environmentally sound until it is located by law enforcement searching the scene for evidence. Housing 23 is of rubber or plastic material or any other rugged material including metal, steel, fiberglass, or laminate. Elapsed timer 30 is viewable through LCD Display 34 and provides law enforcement a time stamp of the exact time of the altercation. Electrical capacitive storage device 35 provides power to elapsed timer 30 for data retention after the main batteries are no longer able to supply power to all systems. Even if PSS 8 is located after a very long time, after main power supply has drained, the time of the event can still be calculated. RF transmitter 9 acts as a homing signal for location discovery and retrieval of PSS 8.

Law enforcement officers use receiver 20 a commercial radio receiver to search for PSS 8 thrown down at the scene. Receiver 20 interrogates the strength of the RF beacon generated by RF transmitter, beacon, and antenna 9 via directional antenna 44. Received signal strength indicator (audible and display) 46 allows the user to determine proximity of PSS 8 both visually through the display and audibly through the receiver's audible broadcast of the beacon. A low-tolerance resistive device 40 is used to alter the audio frequency of the beacon based on temperature therefore giving some indication of the environment of the location where the PSS 8 will be found. When PSS 8 is within range, RF transmitter 9 acts as a homing device to receiver 20 with signal strength displayed on the display of receiver 20 until PSS 8 is located. Receiver 20 may be a small portable commercially available receiver. To protect PSS 8 from possible data loss and to protect the general public from the possible emergency nature of the data inside, interconnect jack 11 for information retrieval is included. Pull-pin 12 resides in interconnect jack 11 until its removal for activation. Reed switch 16 is a concealed and protected switch to enable recorded playback when activated. Proximity magnet 42 activates it. Headphone 19 interfaces to interconnect jack 11 for retrieval of captured information. Solid-state latch 38 is included to assure that the unit can be activated only once. In this way the user is guaranteed a useful system in an emergency. Until PSS 8 is activated the batteries inside the unit are electrically isolated from the unit's electrical circuits to extend the storage life of the unit to that of the useful shelf life of the batteries.

DETAILED DESCRIPTION

FIG. 3—Additional Embodiment with Redundant Components

FIG. 3 shows an additional embodiment of PSS 8 comprising the same embodiment as FIG. 1 with the addition of a RF transmitter 9', and a power source 29'.

Operation—FIG. 3

In addition to the components of FIG. 1, this embodiment includes a redundant RF transmitter, beacon, and antenna 9', and power source 29'. These components are also activated upon removal of pull-pin 12 and remain in place on the victim with pull-ring 10. In this way a homing device also stays with the victim on the chance that the victim is kept in the area where he went missing, he may be found as the search for PSS 8 ensues.

DETAILED DESCRIPTION

FIG. 4—Additional Embodiment with Camera and Video

FIG. 4 shows an additional embodiment of my personal safety system. In this case a camera with video capability 24 and a lens 32 is added. Pictures and/or video are compressed and stored in a solid-state memory 26 and may be uploaded to a computer via interconnect jack 11.

Operation—FIG. 4

In this embodiment camera 24 is added. In addition to recording voice evidence pictures or ambient video of the scene may also be captured allowing even more evidence to be left behind. Upon automatic activation of PSS 8 the victim may collect photos or videos of the scene through lens 32. Camera 24 compresses video and stores it into solid-state memory 26. Perhaps these pictures and or videos will contain pictures of the event, the vehicle, or even the assailant. Interconnect jack 11 provides a method to upload pictures and or video to a computer.

DETAILED DESCRIPTION

FIG. 5—Additional Embodiment

FIG. 5 shows a schematic block diagram of an additional embodiment of my personal safety system. In this embodiment a location discrimination receiver 70 and a transmitter 75 is added.

Operation—FIG. 5

In this embodiment, location discrimination receiver 70 including a GPS type receiver or an E911 type receiver, and transmitter 75 are added to PSS 8. With these additional items if the user forgets to throw PSS 8, they still have a chance to be rescued. When they remember, they simply pull PSS 8 from its location just as in normal operation but in this embodiment in addition to triggering the capture of information, the removal of pull-pin 12 will now also trigger location discrimination receiver 70 and transmitter 75 thereby sending location coordinates over an SMS (Short Message Service)

type network. Transmitter 75 is designed to continually send the coordinates whether stationary or moving. The automatic start of transmitter 75 denotes an emergency situation and location coordinates are received at a PSS monitoring system 90 and disseminated to family, 911, or the victim's local law enforcement for immediate response. In this case, PSS 8 may be activated and thrown down at the scene, be thrown out the car window, or rolled under the seat of the abduction car any of which will trigger an emergency. The unit may be deployed somewhere along the abduction path since with receiver 70 it is not required to be left behind at the crime scene for discovery.

Although it is not required to leave behind at the crime scene because of the added "tracking" capabilities it is recommended that PSS 8 should be deployed early so that it is not discovered on the victim and removed and destroyed. Deployment may be done very discreetly with voice recording if possible, or just thrown down since the unit is already registered to the victim through its unique id 22. Thrown with detailed evidentiary data inside is the first choice, but just the act of throwing PSS 8 along the way before assailant removal gives one a chance to say, "we went this way", "I was here", "look for me in this direction".

DETAILED DESCRIPTION

FIG. 6—Additional Embodiment

FIG. 6 shows a schematic block diagram of PSS Monitoring System 90. It includes a transmission receiving station 95 such as a modem or network that is notified via transmitter 75 when a personal safety system has been deployed. It resolves against a G.I.S. Database 80 that resides on a computer 85.

Operation—FIG. 6

FIG. 6 shows a schematic block diagram of PSS Monitoring System 90 that is notified when the embodiment represented in FIG. 5 is deployed. Station 95 such as a modem or network is notified via transmitter 75 that a unique PSS 8 has been deployed along with the location coordinates of that deployment. Transmitter 75 is designed to continue transmitting location coordinates whether the unit is stationary or moving.

DETAILED DESCRIPTION

FIG. 7—Flowchart of PSS Initialization and Power Control System

In the preferred embodiment of my personal safety system, the factory final test will be exercised on a production unit and the unit will be placed from unit-initialized mode 51 into a zero power standby state 52 for delivery to the end user.

Upon unit activation by the user 53, a one time use latch is activated 54. It is included to assure that the unit can be activated only once to maintain battery performance. As delivered to the customer, the batteries inside the unit are electrically isolated from the unit's electrical circuits to extend the storage life of the unit to that of the useful shelf life of the battery source utilized.

Subsequent user attempts at activation 53 will not restart information capture 56 or elapsed time counter activation 60. This functionality is provided by one time latch activation 54 which will store the singular event of end user activation.

After one time latch activation 54 is set, that state will be retained throughout the extent of the battery life of the unit. In addition, elapsed time counter activation 60 includes a method to begin charging elapsed time counter power reserve 61 which provides power to elapsed time counter for data retention after the main batteries are no longer able to supply power to all unit systems with the exception of the state of one time latch mechanism 54.

Upon detection of first time use, the unit will enter into an activation cascade (54 through 63) which powers each electrical subsystem and allows each subsystem to automatically enter their desired operating mode.

Audio/Video Capture units 56 will record to their programmed timed limits, and then enter their Power Down stages 58.

Upon location telemetry beacon power up 59 the monolithic CMOS transmitter stabilizes and begins transmitting a location identification beacon with characteristics that aid in its forensic recovery including special location, determination of the Beacon's ambient temperature, and the time-to-activation based on transmitting characteristics of the telemetry signal transmitted.

Elapsed timer counter begins counting 60, and elapsed timer counter power preservation 61 begins charging of electrical capacitive storage device 35 (FIG. 1), which preserves the forensic elapsed time data.

Information recording in terms of audio and/or video 56 begins and continues until its non-volatile recording length 57 is reached, upon which recording device enters power down state 58 and the non-volatile ambient collected data is saved for later retrieval and recovery 63.

Subsequent user activation 53 of personal safety system 8 (FIG. 1) will query one time use latch activation 54 and prevent subsequent use and overwriting of original forensic audio and/or video content.

From the descriptions above, a number of advantages of my personal safety system become evident:

(a) this device does not need to remain with the individual to provide evidence—in fact the whole theory is to leave it behind as a shred of evidence (b) this device includes a unique id complete with registration record that allows law enforcement to search for that unit and determine the owner of the PSS (c) works anywhere since it is not dependent on any kind of tracking coverage, just knowledge of where the person likely was when they went missing (d) my PSS is designed to tell a story, if a prior art tracking device is removed and is even later found its only evidentiary value is possible fingerprints or ownership, but even if located it can't tell a story (e) with my PSS batteries will retain full power without depletion until activation; activation only upon event; battery power planned for recovery time cycle (f) no extensive price prohibitive RF infrastructure is required for this system to work—rather leave it behind as evidence and a portable RF receiver will find it (g) cost/risk justification is very good for my personal safety system—little cost, little risk to own several thereby always having one close by and easily accessible (h) it is a deterrent—if the assailant sees one record-and-throw they may drive off and leave the person alone; or, if the assailant sees one throw a device into the bushes or over a nearby fence, he may try to get it thereby giving the person the split second one needs to get away or for a passerby to offer assistance or at least see something (i) in an additional embodiment an added location discrimination receiver allows for traceability if the user was not rapid enough to throw the device at the scene; it may be thrown down on the floorboard of the abduction car or somewhere along the abduction path so that it is not removed and destroyed by the assailant

CONCLUSIONS, RAMIFICATIONS, AND SCOPE

Accordingly, the reader will see that my personal safety system can gather evidence, store that evidence securely, leave it behind safely, then provide that it be located and retrieved. The evidence may be used to enable a quick rescue and bring a victim home; or in the best of all cases, prevent the abduction in the first place.

Further, my personal safety system:

- is not dependent on remaining with the victim
- in additional embodiments offers a RF Beacon to remain with the victim while still leaving the collected evidence behind
- works anywhere, with or without RF coverage
- upon discovery at the crime scene will provide evidence compared to other devices rendered useless when removed by the assailant and discarded
- has a unique id registered to the owner
- is an emergency only device so batteries are always ready and activated only upon system activation
- utilizes a very low power RF transmitter which is activated only upon device activation
- requires no extensive RF infrastructure for system to work
- has a good cost/risk/justification—components are commercially available and are at commodity prices—price performance is good enough to have many at a time and throw as many as you can in an emergency to cause a deterrent
- is also a deterrent prompting a change of mind for the assailant or a much needed moment to get away if the assailant trys to find the thrown device; also a chance for a passerby to stop, help, or at least see something for later disclosure Although the description above contains many specificities, these should not be construed as limiting the scope of the personal safety system but rather as an exemplification of one preferred embodiment and additional embodiments thereof. Many other variations are possible. For example the housing can have many shapes such as stars, circles, squares, toys, animals, flowers, pen shaped, dolls or monsters. Also stealth units disguised for example as a roll of Certs or a Chap-Stick container will also be provided. These may be worn on a necklace, on a hair barrette, or a zipper pull, a backpack, on shoelaces, the car dash, the bedside, on a belt loop, or it could be a watch, ring, or necklace with removable module to throw or leave behind.

Also, an emergency is not the only time to capture an event, the device may be used as an event recorder also, such as to record a marriage proposal or similar event. It could operate at any radio or microware frequency in the RF spectrum to include but not limited to UHF, 27 MHz, 400 MHz, 902-928 MHz, 2.4-2.483 GHz, 4.9 GHz, or 5.2-5.8 GHz.

Thus the scope of the personal safety system should be determined by the appended claims and their legal equivalents, rather than by the examples given.

I claim:

1. A system for capturing information, signaling position, and retrieval of said information comprising:

(a) a data collection unit, the data collection unit comprising:

(i) a first means for capturing information;

(ii) a second means for telemetry signaling for position discovery;

(iii) a third means for activating and controlling a power source;

(iv) a housing surrounding and encasing said first means, said second means, and said third means; and (v) a fourth means for retrieving said information from said data collection unit.

2. The system of claim 1, wherein said third means provides power interruption in such a way that activation of said third means allows power to flow to any or all electrical components of said data collection unit comprising but not limited to said first means and said second means and making each operable automatically.

3. The system of claim 1, wherein said third means is a pull-pin that when removed allows power to flow and activate components.

4. The system of claim 3, further including a pull-ring attached to said pull-pin for ease of said pull-pin removal.

5. The system of claim 4, wherein said pull-ring is used to attach said data collection unit in a multitude of places including but not limited to clothing, or a purse, or shoes, or a backpack, or pajamas, or a bedside table, or a vehicle dashboard.

6. The system of claim 1, wherein mechanical removal of said third means initiates an electrical cascade automating the operation of said data collection unit.

7. The system of claim 6, wherein said electrical cascade is not interrupted by mechanical re-insertion of said third means.

8. The system of claim 6, wherein said system will perform said electrical cascade only as a single one-time event.

9. The system of claim 6, further including a latching mechanism means for assuring the automated electrical cascade as a single one-time event.

10. The system of claim 9, wherein said latching mechanism means is comprised of a solid-state latch.

11. The system of claim 1, wherein said information is ambient audio.

12. The system of claim 11, wherein said first means for capturing information of said ambient audio is comprised of a microphone, a capture means, and an archive means.

13. The system of claim 12, wherein said first means for capturing information of said ambient audio is comprised of a monolithic solid-state device.

14. The system of claim 12, wherein said archive means for archive of said ambient audio is a solid-state memory.

15. The system of claim 14, wherein said solid-state memory is a non-volatile memory.

16. The system of claim 15, wherein said non-volatile memory is comprised of flash memory technology.

17. The system of claim 12 or claim 13, wherein said first means for capturing information of said ambient audio and said archive means are both integrated into a single monolithic device.

18. The system of claim 1, wherein said information is ambient video.

19. The system of claim 18, further including a camera with video capability, a lens, a video compression means, and an archive means for capturing said ambient video.

20. The system of claim 19, wherein said camera with video capability for capturing said ambient video is a monolithic solid-state device.

21. The system of claim 19, wherein said archive means of said ambient video is solid-state memory.

22. The system of claim 19, wherein said camera with video capability and said video compression means are integrated onto a single monolithic solid-state device.

23. The system of claim 19, wherein said camera with video capability is integrated with said lens into a single integrated module.

24. The system of claim 19, wherein said ambient video is compressed before archival in a non-volatile memory storage.

25. The system of claim 24, wherein said non-volatile memory storage is comprised of flash memory technology.

26. The system of claim 19, further including non-volatile memory for storage of said ambient video.

27. The system of claim 19, wherein said camera with video capability, said video compression means, and said archive means are integrated onto a single monolithic solid-state device.

28. The system of claim 1, further including an elapsed timer for determining an elapsed amount of time since system activation by said third means to provide a time stamp.

29. The system of claim 28, further including a means for digital registration of said elapsed amount of time.

30. The system of claim 28, further including a means for archive of said elapsed amount of time after the primary power source has been exhausted.

31. The system of claim 28, further including a means of power for preserving counter logic state after exhaustion of the primary power source.

32. The system of claim 28, further including an integrated liquid crystal display of said elapsed amount of time since power activation.

33. The system of claim 31, wherein said means of power for preserving counter logic state includes the use of an electrical capacitive storage device.

34. The system of claim 1, wherein said second means is comprised of a radio frequency transmitter and its integrated antenna.

35. The system of claim 34, wherein said second means of said radio frequency transmitter and its integrated antenna operate at a frequency from a group including but not limited to ultrahigh frequency, 27 megahertz, 400 megahertz, 900 megahertz, 2.4 gigahertz, 4.9 gigahertz, and 5.2-5.8 gigahertz frequency bands.

36. The system of claim 34, wherein said second means of said radio frequency transmitter and its integrated antenna are comprised of passive or active technology.

37. The system of claim 34, wherein said second means of said radio frequency transmitter and its integrated antenna utilizes frequency shift keying modulation techniques.

38. The system of claim 34, further including a radio frequency beacon utilizing a signal generation means for modulating the frequency shift keying signal.

39. The system of claim 38, wherein said signal generation means produces a signal within audible frequency range of readily available commercial radio receivers.

40. The system of claim 38, wherein said signal generation means varies an audio frequency of said radio frequency beacon based on the ambient temperature of said data collection unit described.

41. The system of claim 38, wherein said signal generation means driving the frequency shift keying input of said radio frequency transmitter is modulated with a period of variable length.

42. The system of claim 41, wherein said period of variable length is determined by a means of signal generation.

43. The system of claim 41, wherein said period of variable length gates said means of signal generation based on available battery life.

44. The system of claim 41, wherein the modulation of said period of variable length is representative of the amount of local storage power remaining.

45. The system of claim 40, wherein the means for determining said ambient temperature involves manipulation of said audio frequency.

46. The system of claim 40, wherein said signal generation means for varying said audio frequency of said radio frequency beacon is comprised of a temperature-sensitive electronic element.

47. The system of claim 46, wherein said temperature-sensitive electronic element is comprised of a low-tolerance resistive device.

48. The system of claim 34, wherein said second means of said radio frequency transmitter and its integrated antenna is comprised of a monolithic solid-state device.

49. The system of claim 48, wherein said monolithic solid-state device consists of one printed circuit board.

50. The system of claim 1, wherein said housing is of a multitude of shapes including but not limited to, the shape of a rectangle, or star, or hourglass, or disguised as a package of gum or a lipstick.

51. The system of claim 1 wherein said housing is suitable material for best range of said second means including a multitude of materials comprising but not limited to metal, plastic, fiberglass, laminate, or rubber materials.

52. The system of claim 51, wherein said materials comprise an outer coating which is conducive to the retention of latent fingerprints.

53. The system of claim 1, wherein said housing is rugged and environmentally sound such that said data collection unit may be thrown down.

54. The system of claim 1, further comprising:

(b) a locating system, the locating system comprising:

(vi) a fifth means for locating said telemetry signaling of said data collection unit, whereby said information may be extracted upon locating said data collection unit, wherein said fifth means used for positional location of said telemetry signaling is comprised of a radio frequency receiver and an antenna device.

55. The system of claim 54, wherein said fifth means of said radio frequency receiver and antenna device is comprised of an audio generation means, based on active recovery of said second means.

56. The system of claim 54, further including a received signal strength indicator representing signal strength of said second means.

57. The system of claim 54, wherein said antenna device is comprised of a directional antenna apparatus.

58. The system of claim 57, wherein said directional antenna apparatus is comprised of a means for active control of a plurality of antenna elements.

59. The system of claim 1, further including a location discrimination receiver from a group including but not limited to a GPS receiver or an E911 receiver, and a transmitter.

60. The system of claim 59, further including a personal safety system monitoring system including but not limited to a transmission receiving station, a geographical information system database and a computer.

61. The system of claim 1, wherein said fourth means includes an active electrical retrieval means, and a plurality of passive means.

62. The system of claim 61, further including an electrical interconnect means for retrieval of said information.

63. The system of claim 61, wherein said electrical interconnect means includes an interconnect jack facilitating retrieval of captured data comprising but not limited to audio or video utilizing a plurality of devices not limited to a headphone, headsets, portable speakers, video monitors, and an interconnection to a common personal computer.

64. The system of claim 63, wherein said interconnect jack acts as the device activation means allowing power to flow to any or all electrical components of said system.

65. The system of claim 61, wherein said plurality of passive means includes electrical induction.

66. The system of claim 61, wherein said plurality of passive means includes magnetic induction.

67. The system of claim 61, wherein said plurality of passive means includes radio frequency propagation.

68. The system of claims 65, 66, or 67, wherein said plurality of passive means are passive and do not require mechanical or electrical interaction with said housing.

69. The system of claim 61, wherein said plurality of passive means includes magnetic induction interacting with a reed switch or a hall-effect device with said housing of said data collection unit.

70. The system of claim 1, wherein said fourth means comprises a reed switch or a manual switch.

71. The system of claim 1, further including audio extraction through passive means, these means including but not limited to internal generation of audio, electromagnetic means, or radio frequency transmission means.

72. A system for capturing information, signaling position, and retrieval of the captured information comprising:

(a) a data collection unit, the data collection unit comprising:

(i) a voice recorder with playback capability;

(ii) a radio frequency transmitter;

(iii) a pull-pin for activating and controlling a power source; and (iv) a housing surrounding and encasing said voice recorder with playback capability, said radio frequency transmitter, and said pull-pin; and (v) an electrical interconnect for retrieving said information from said data collection unit; and (b) a locating system, the locating system comprising:

(vi) a radio frequency receiver and antenna apparatus for locating said radio frequency transmitter of said data collection unit, whereby the captured information may be extracted upon locating said data collection unit.

73. The system of claim 72, wherein said pull-pin provides power interruption in such a way that removal of which allows power to flow to any or all electrical components of said data collection unit.

74. The system of claim 73, further including a pull-ring attached to said pull-pin for ease of said pull-pin removal.

75. The system of claim 72, wherein mechanical removal of said pull-pin initiates an electrical cascade automating the operation of said data collection unit.

76. The system of claim 75, wherein said electrical cascade is not interrupted by mechanical re-insertion of said pull-pin.

77. The system of claim 75, wherein said system will perform said automated electrical cascade only as a single one-time event.

78. The system of claim 75, further including a solid-state latching mechanism for assuring the automated electrical cascade as a single one-time event.

79. The system of claim 72, wherein said information is ambient audio.

80. The system of claim 72, wherein said voice recorder with playback capability is a monolithic solid-state device.

81. The system of claim 80, wherein said monolithic solid-state device is comprised of a non-volatile memory.

82. The system of claim 81, wherein said non-volatile memory is comprised of flash memory technology.

83. The system of claim 72, wherein said information is ambient video.

84. The system of claim 83, further including a camera with video capability, a lens, and a non-volatile solid-state memory for storage of said ambient video.

85. The system of claim 84, wherein said camera with video capability for capturing said ambient video is a monolithic solid-state device.

86. The system of claim 84, wherein said camera with video capability is integrated with said lens into a single integrated module.

87. The system of claim 84, wherein said ambient video is compressed before archival in said non-volatile solid-state memory.

88. The system of claim 87, wherein said non-volatile solid-state memory is comprised of flash memory technology.

89. The system of claim 72, further including an elapsed timer for determining an elapsed amount of time since system activation.

90. The system of claim 89, further including an electrical capacitive storage device for preserving counter logic state of said elapsed timer after exhaustion of the primary power source.

91. The system of claim 89, further including an integrated liquid crystal display for viewing said amount of elapsed time since system activation.

92. The system of claim 72, wherein said radio frequency transmitter and its integrated antenna operate at a frequency from a group including but not limited to ultrahigh frequency, 27 megahertz, 400 megahertz, 900 megahertz, 2.4 gigahertz, 4.9 gigahertz, and 5.2-5.8 gigahertz frequency bands.

93. The system of claim 72, wherein said radio frequency transmitter and its integrated antenna are comprised of passive or active technology.

94. The system of claim 72, wherein said radio frequency transmitter and its integrated antenna utilizes frequency shift keying modulation techniques.

95. The system of claim 72, further including a radio frequency beacon with a signal generator modulating the frequency shift keying signal.

96. The system of claim 95, wherein said radio frequency beacon produces a signal within audible frequency range of readily available commercial radio receivers.

97. The system of claim 96, further including a signal generator that varies an audio frequency of said radio frequency beacon based on an ambient temperature of said data collection unit described.

98. The system of claim 95, wherein said signal generator driving the frequency shift keying input of said radio frequency transmitter is modulated with a period of variable length.

99. The system of claim 98, wherein said period of variable length is determined by a means of signal generation.

100. The system of claim 98, wherein said period of variable length gates said radio frequency transmitter based on available battery life.

101. The system of claim 98, wherein the modulation of said period of variable length is representative of the amount of local storage power remaining.

102. The system of claim 97, wherein said ambient temperature involves manipulation of said audio frequency.

103. The system of claim 97, wherein said signal generator for varying said audio frequency of said radio frequency beacon is comprised of a temperature-sensitive electronic element.

104. The system of claim 103, wherein said temperature-sensitive electronic element is comprised of a low-tolerance resistive device.

105. The system of claim 72, wherein said radio frequency transmitter and its integrated antenna is comprised of a monolithic solid-state device.

106. The system of claim 105, wherein said monolithic solid-state device comprises one printed circuit board.

107. The system of claim 72, wherein said housing is of a multitude of shapes including but not limited to, the shape of a rectangle, or star, or hourglass, or disguised as a package of gum or a lipstick.

108. The system of claim 72, wherein said housing is suitable material for best range of said radio frequency transmitter including a multitude of materials comprising but not limited to metal, plastic, fiberglass, laminate, or rubber materials.

109. The system of claim 108, wherein said materials comprise an outer coating which is conducive to the retention of latent fingerprints.

110. The system of claim 72, wherein said housing is rugged and environmentally sound such that said data collection unit may be thrown down.

111. The system of claim 72, wherein said radio frequency receiver and antenna apparatus includes an audible beeping tone, based on active recovery of said radio frequency transmitter.

112. The system of claim 72, wherein said radio frequency receiver and antenna apparatus includes a received signal strength indicator.

113. The system of claim 72, wherein said radio frequency receiver and antenna apparatus is comprised of a directional antenna apparatus.

114. The system of claim 113, wherein said directional antenna apparatus has active control of a plurality of antenna elements.

115. The system of claim 72, further including a location discrimination receiver from a group including but not limited to a GPS receiver or an E911 receiver, and a transmitter.

116. The system of claim 115, further including a personal safety system monitoring system including but not limited to a transmission receiving station, a geographical information system database and a computer.

117. The system of claim 72, wherein said electrical interconnect is an active interconnect jack, or a plurality of passive retrieval methods to retrieve said information.

118. The system of claim 117, wherein said active interconnect jack facilitates retrieval of captured data comprising but not limited to audio or video utilizing a plurality of devices not limited to a headphone, headsets, portable speakers, video monitors, or an interconnection to a common personal computer.

119. The system of claim 117, wherein said plurality of passive retrieval methods include electrical induction, magnetic induction, or radio frequency propagation.

120. The system of claim 119, wherein said plurality of passive retrieval methods are passive and do not require mechanical or electrical interaction with said housing.

121. The system of claim 119, wherein said magnetic induction includes magnetic induction interacting with a reed switch or hall-effect device with said housing of said data collection unit.

122. The system of claim 72, further including a reed switch or hall-effect device for magnetic induction interacting with said housing of said data collection unit for retrieval of said information.

123. The system of claim 72, wherein said electrical interconnect comprises a manual switch for retrieval of said information.

124. The system of claim 123, further including a headphone or speaker for hearing said information.

125. A method for capturing information, signaling position, and retrieving the captured information, comprising:

(a) providing a data collection unit, the data collection unit comprising
  (i) providing a voice recorder with playback capability;
  (ii) providing a radio frequency transmitter;
  (iii) providing a pull-pin for activating and controlling a power source; and
  (iv) providing a housing surrounding and encasing said voice recorder with playback capability, said radio frequency transmitter, and said pull-pin; and
  (v) providing an electrical interconnect for retrieving said information from said data collection unit; and (b) providing a locating system, the locating system comprising:
  (vi) providing a radio frequency receiver and antenna device for locating said radio frequency transmitter of said data collection unit, whereby the captured information may be extracted upon locating said data collection unit.

126. The method of claim 125, wherein said pull-pin provides power interruption in such a way that removal of which allows power to flow to any or all electrical components of said data collection unit.

127. The method of claim 126, further including a pull-ring attached to said pull-pin for ease of said pull-pin removal.

128. The method of claim 125, wherein the removal of said pull-pin initiates an electrical cascade automating the operation of said data collection unit.

129. The method of claim 125, wherein said voice recorder with playback capability is a monolithic solid-state device.

130. The method of claim 129, wherein said monolithic solid-state device is comprised of a memory that is non-volatile.

131. The method of claim 130, wherein said memory that is non-volatile is comprised of flash memory technology.

132. The method of claim 125, wherein said information being captured is ambient video.

133. The method of claim 132, further including a camera with video capability, a lens, and non-volatile solid-state memory for storage.

134. The method of claim 133, wherein said camera with video capability for capturing said ambient video is a monolithic solid-state device.

135. The method of claim 133, wherein said camera with video capability is integrated with said lens into a single integrated module.

136. The method of claim 133, wherein said ambient video is compressed before archival in said non-volatile solid-state memory.

137. The method of claim 133, wherein said non-volatile solid-state memory is comprised of flash memory technology.

138. The method of claim 125, further including an elapsed timer for determining an elapsed amount of time since system activation.

139. The method of claim 138, further including an electrical capacitive storage device for preserving counter logic state of said elapsed timer after exhaustion of the primary power source.

140. The method of claim 138, further including an integrated liquid crystal display for viewing said elapsed amount of time since system activation.

141. The method of claim 125, wherein said radio frequency transmitter and its integrated antenna operate at a frequency from a group including but not limited to ultrahigh frequency, 27 megahertz, 400 megahertz, 900 megahertz, 2.4 gigahertz, 4.9 gigahertz, and 5.2-5.8 gigahertz frequency bands.

142. The method of claim 125, wherein said radio frequency transmitter and its integrated antenna are comprised of passive or active technology.

143. The method of claim 125, wherein said radio frequency transmitter and its integrated antenna utilizes frequency shift keying modulation techniques.

144. The method of claim 125, further including a radio frequency beacon with a signal generator modulating the frequency shift keying signal.

145. The method of claim 144, wherein said radio frequency beacon produces a signal within audible frequency range of readily available commercial radio receivers.

146. The method of claim 145, further including a signal generator that varies an audio frequency tone of said radio frequency beacon based on the ambient temperature of the data collection unit described.

147. The method of claim 144, wherein said signal generator driving the frequency shift keying input of said radio frequency transmitter is modulated with a period of variable length.

148. The method of claim 147, wherein said period of variable length is determined by a means of signal generation.

149. The method of claim 147, wherein said period of variable length gates said radio frequency transmitter based on available battery life.

150. The method of claim 147, wherein the modulation of said period of variable length is representative of the amount of local storage power remaining.

151. The method of claim 146, wherein said ambient temperature involves manipulation of said audio frequency tone.

152. The method of claim 146, wherein said signal generator for varying said audio frequency tone of said radio frequency beacon is comprised of a temperature-sensitive electronic element.

153. The method of claim 152, wherein said temperature-sensitive electronic element is comprised of a low-tolerance resistive device.

154. The method of claim 125, wherein said radio frequency transmitter and its integrated antenna is comprised of a monolithic solid-state device.

155. The method of claim 154, wherein said monolithic solid-state device comprises one printed circuit board.

156. The method of claim 125, wherein said housing is of a multitude of shapes including but not limited to, the shape of a rectangle, or star, or hourglass, or disguised as a package of gun or a lipstick.

157. The method of claim 125, wherein said housing is suitable material for best range of said radio frequency transmitter including a multitude of materials comprising but not limited to metal, plastic, fiberglass, laminate, or rubber materials.

158. The method of claim 157, wherein said materials comprise an outer coating which is conducive to the retention of latent fingerprints.

159. The method of claim 125, wherein said housing is rugged and environmentally sound such that said data collection unit may be thrown down.

160. The method of claim 125, wherein said radio frequency receiver and antenna apparatus includes an audible beeping tone, based on active recovery of said radio frequency transmitter.

161. The method of claim 125, wherein said radio frequency receiver and antenna apparatus includes a received signal strength indicator.

162. The method of claim 125, wherein said radio frequency receiver and antenna device is comprised of a directional antenna apparatus.

163. The method of claim 162, wherein said directional antenna apparatus has active control of a plurality of antenna elements.

164. The method of claim 125, further including a location discrimination receiver from a group including but not limited to a OPS receiver or an E911 receiver, and a transmitter.

165. The method of claim 164, further including a personal safety system monitoring method including but not limited to a transmission receiving station, a geographical information system database and a computer.

166. The method of claim 125, wherein said electrical interconnect is an active interconnect jack, or a plurality of passive retrieval methods to retrieve said information.

167. The method of claim 166, wherein said active interconnect jack facilitates retrieval of captured data comprising but not limited to audio or video utilizing a plurality of devices not limited to a headphone, headsets, portable speakers, video monitors, or an interconnection to a common personal computer.

168. The method of claim 166, wherein said plurality of passive retrieval methods include electrical induction, magnetic induction, or radio frequency propagation.

169. The method of claim 168, wherein said plurality of passive retrieval methods are passive and do not require mechanical or electrical interaction with said housing.

170. The method of claim 168, wherein said magnetic induction includes a magnetic induction interacting with a reed switch or hall-effect device with said housing of said data collection unit.

171. The method of claim 125, further including a reed switch or hall-effect device for said magnetic induction interacting with said housing of said data collection unit for retrieval of said information.

172. The method of claim 125, wherein said electrical interconnect comprising a manual switch for retrieval of said information.

173. The method of claim 172, further including a headphone or speaker for hearing said information.

* * * * *